US007489894B2

(12) United States Patent
Sato et al.

(10) Patent No.: US 7,489,894 B2
(45) Date of Patent: Feb. 10, 2009

(54) IMAGE FORMING APPARATUS WITH BELT SURFACE REGULATING MEMBER

(75) Inventors: Yotaro Sato, Hachioji (JP); Takenobu Kimura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 44 days.

(21) Appl. No.: 11/455,591

(22) Filed: Jun. 19, 2006

(65) Prior Publication Data

US 2007/0048030 A1 Mar. 1, 2007

(30) Foreign Application Priority Data

Aug. 24, 2005 (JP) ..... 2005-242408

(51) Int. Cl.
*G03G 15/16* (2006.01)

(52) U.S. Cl. ..... 399/296

(58) Field of Classification Search ..... 399/296
See application file for complete search history.

(56) References Cited

U.S. PATENT DOCUMENTS 5,740,508 A * 4/1998 Matsuura et al. ..... 399/308
6,097,919 A * 8/2000 Takeuchi et al. ..... 399/298
6,160,980 A * 12/2000 Ziegelmuller et al. ..... 399/303
6,594,138 B1 * 7/2003 Belyakov et al. ..... 361/502
2006/0209151 A1 * 9/2006 Tamiya et al. ..... 347/103

FOREIGN PATENT DOCUMENTS

JP 60164784 A * 8/1985
JP 02010168 A * 1/1990
JP 02179670 A * 7/1990
JP 10-274892 10/1998
JP 11095535 A * 4/1999
JP 11-143255 5/1999

* cited by examiner

*Primary Examiner*—Quana M Grainger
(74) *Attorney, Agent, or Firm*—Cantor Colburn LLP

(57) ABSTRACT

An image forming apparatus for a color print having an intermediate transfer belt and a plurality of image forming devices, wherein each image forming device has a photoreceptor and a developing device, and toner images formed on photoreceptors by the developing devices are primarily transferred onto the intermediate transfer belt to form a superimposed toner image and further the superimposed toner image is secondarily transferred in a batch onto a transfer member, the apparatus including: a charging or neutralizing device; a conductive elastic member, as a counter electrode for the charging or neutralizing device; and a belt surface regulating member disposed in a vicinity of the conductive elastic member to regulate a position of the surface of the intermediate transfer belt.

5 Claims, 4 Drawing Sheets

IMAGE FORMING APPARATUS WITH BELT SURFACE REGULATING MEMBER

FIELD OF THE INVENTION

The present invention relates to an image forming apparatus, such as a copier, printer, or fax machine, and particularly relates to an image forming apparatus that uses an intermediate transfer belt.

BACKGROUND OF THE INVENTION

An electrophotographic image forming apparatus forms a color image by superimposing toner images, in respective colors carried on photoreceptors, on each other on the intermediate transfer belt in a primary transfer section and then secondarily transfers the superimposed toner image from the intermediate transfer belt to a transfer material. In such an electrophotographic image forming apparatus, the amount of electrical charge of toner on the intermediate transfer belt varies with the number of times, environment or the like of performing the primary transfer. Accordingly, various image defects tend to occur at the time of the secondary transfer from the intermediate transfer belt to the transfer material.

In this situation, there are offered technologies that uniforms the amount of electrical charge of a toner image by charging of a toner image having been primarily transferred to an intermediate transfer belt, with corona discharge from a pre-secondary transfer charging device (for example, refer to Japanese Unexamined Patent Application Publication Nos. H10-274892 and H11-143255).

On the other hand, in order to prevent irregularity of density due to an electrical charge shortage for transfer which occurs when the toner adherence amount is large and the electrical potential of the toner layer is high, and also to prevent a discharge which is caused by increasing the transfer charge amount, the inventors are considering a technology to electrically neutralize a toner image on an intermediate transfer belt prior to secondary transfer.

Specifically, a toner image on an intermediate transfer belt is neutralized by installing a scorotron electrode on the upstream side of the secondary transfer. Herein, it is preferable to employ an elastic member of which surface is a conductive brush, conductive sponge, or the like, for the counter electrode which is pressed to contact with the intermediate transfer belt so that tight-contactability with the back surface of the intermediate transfer belt is improved.

However, when an elastic member is pressed on a belt, instability of the surface of the running belt affects the downstream side of a nip section for the primary transfer and the upstream side of a nip section for the secondary transfer, causing a problem of instability of image quality due to splashing of toner on a periphery of a character or thin line or roughness of an image caused by irregular discharge.

An object of the invention is to provide an image forming apparatus that prevents problems, as described above, and maintains a stable image with a regulating member for regulating the position of an intermediate transfer belt surface.

SUMMARY OF THE INVENTION

The invention includes the following structure.

An image forming apparatus for a color print having an intermediate transfer belt and a plurality of image forming devices disposed sequentially along a running direction of the intermediate transfer belt, wherein each image forming device has a photoreceptor and a developing device, and toner images formed on photoreceptors by the plurality of developing devices are primarily transferred in sequence onto the intermediate transfer belt at respective primary transfer positions to form a superimposed toner image and further the superimposed toner image is secondarily transferred in a batch onto a transfer member at a secondary transfer position, the apparatus including:

a charging or neutralizing device disposed at a part which is on a downstream side of the primary transfer position being on a most downstream side along the running direction of the intermediate transfer belt and on an upstream side, of the secondary transfer position;

a conductive elastic member, as a counter electrode for the charging or neutralizing device, disposed on a back surface side of the intermediate transfer belt opposite to a surface on which the superimposed toner image is formed; and a belt surface regulating member disposed in a vicinity of the conductive elastic member to regulate a position of the surface of the intermediate transfer belt.

PREFERRED EMBODIMENT OF THE INVENTION

An entire image forming apparatus in the present embodiment will be described first.

The terms and words used in this specification for description of the present embodiment do not limit the scope of the invention.

Figure 1:
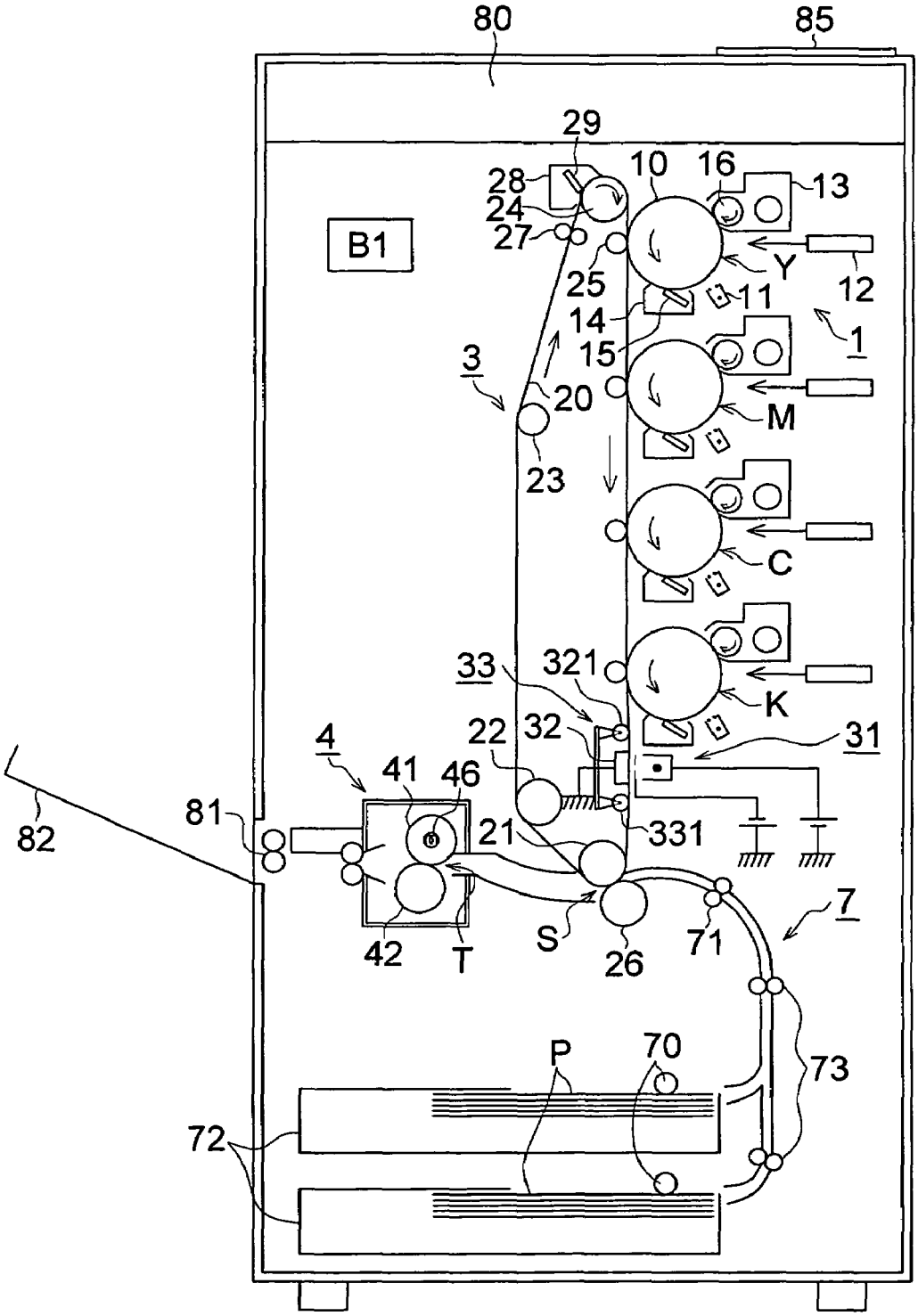
FIG. 1 is a schematic diagram showing an example of an image forming apparatus in accordance with the invention.

FIG. 1 is a schematic diagram showing an example of an image forming apparatus in accordance with the invention.

In FIG. 1, the image forming apparatus includes photoreceptors 10, scorotron chargers 11, writing devices 12 as exposure means, developing devices 13, cleaning devices 14 for cleaning the surface of the photoreceptors 10, cleaning blades 15, developing sleeves 16 and an intermediate transfer belt 20. An image forming device includes the photoreceptors 10, scorotron chargers 11, developing devices 13, cleaning devices 14, etc. Herein, the image forming device 1 has the same mechanical structures for respective colors, and therefore reference symbols are given only to elements of the structure for Y (yellow), while reference symbols for elements of structures for M (magenta), C (cyan) and K (black) are omitted.

The structures in the image forming device 1 for the respective colors are disposed in the order of Y, M, C and K along the running direction of the intermediate transfer belt 20, wherein each photoreceptor 10 is in contact with the tension surface of the intermediate transfer belt 20 and rotates in the same direction and at the same linear speed as the intermediate transfer belt 20 at the contact point.

The intermediate transfer belt 20 is supported with tension by a driving roller 21, conveying roller 22, tension roller 23 and driven roller 23, and constructs a belt unit 3 together with these rollers, the intermediate transfer belt 20, transfer device 25, cleaning device 28 and others.

The intermediate transfer belt 20 runs, driven by rotation of the driving roller 21 that is driven by a driving motor, not shown.

Each photoreceptor 10 is produced in such a manner that the outer surface of a cylindrical metallic body made of, for example, aluminum is formed with a conductive layer and a photosensitive layer, such as a-Si layer or organic photoconductor (OPC), and rotates counterclockwise, as shown in FIG. 1 with an arrow, wherein the conductive layer is earthed.

Electrical signals corresponding to image data from reading device 80 are converted into optical signals by an image forming laser to be projected onto a photoreceptor 10 by a writing device 12.

A developing device 13 keeps a certain distance from the circumferential surface of a photoreceptor 10 and has a developing sleeve 16 formed of nonmagnetic stainless steel or aluminum material in a tube shape which rotates in the same direction as the photoreceptor 10.

The intermediate transfer belt 20 is an endless belt with a volume resistivity of $10^6$ to $10^{12}$ Ω·cm. An example of an intermediate transfer belt 20 is a semiconductive seamless belt with a thickness of 0.04 to 0.10 mm and produced by distributing conductive material on an engineering plastic material, such as denaturation polyimide, heat curing polyimide, an ethylene tetrafluoroethylene copolymer, polyvinylidene fluoride, and a nylon alloy.

A transfer device 25 for primary transfer is disposed at a primary transfer position, applies a direct current of polarity opposite to the toner, and thereby transfers the toner imager formed on the photoreceptor 10 to the intermediate transfer belt 20. The transfer device 25 can be a corona discharger or a transfer roller as well.

A transfer roller 26 for secondary transfer is attachable to and detachable from the earthed driving roller 21 and retransfers, as secondary transfer, the tone image formed on the intermediate transfer belt 20 onto a transfer material P which is a recording sheet.

A cleaning device 28 is arranged facing the driven roller 24 with the intermediate transfer belt 20 therebetween. After the transfer of the toner image to the transfer material P, on the intermediate transfer belt 20, electrical charges of the residual toner on the circumferential surface are reduced by a neutralizing roller 27 applied with an AC voltage for which DC voltage of the same polarity as or opposite polarity to the toner is superimposed so that toner remaining on the circumferential surface is cleaned off by the cleaning blade 29. A pre-secondary transfer neutralizing device 31 is a charging or neutralizing unit of a scorotron electrode type, and an electrode 32 is a counter electrode to it. A belt surface regulating member 33 regulates the position of the surface of the intermediate transfer belt, and a roller 331 is a belt tension-support roller of the regulating member 33, which are related to the invention. Details will be described later.

A fixing device 4 includes a heat roller 41, a pressure roller 42, etc. and fixes the transfer material P, onto which the toner image has been transferred at a nip section S between the transfer roller 26 and the driving roller 21, at a nip section T of the fixing device 4.

There are arranged a conveyance path 7, sheet feeding rollers 70, timing rollers 71, paper sheet cassettes 72, and conveying rollers 73.

There are also arranged sheet ejection rollers 81, a sheet ejection tray 82, and an operation panel 85. Control section B1 controls the image forming process, transfer material conveyance, fixing temperature, and the like.

Next, a device, in accordance with the invention, for regulating the position of the belt surface prior to secondary transfer will be described.

As stated above, in the case of performing neutralization of a toner image on the intermediate transfer belt with a scorotron electrode installed on the upstream side of secondary transfer, an elastic member is employed for the counter electrode. Herein, the surface of the elastic member to be in press contact with the intermediate transfer belt is a conductive brush, a conductive sponge, or the like, so as to improve the tight-contactability with the back surface of the intermediate transfer belt. However, when the elastic member is pressed against the belt, a problem occurs that the belt surface becomes unstable.

According to the invention, a belt surface regulating member for regulating the position of the surface of an intermediate transfer belt prevents problems, described above, and maintains stable images.

The invention will be described below, referring to FIGS. 2*a* to 2*c*.

FIGS. 2*a* to 2*c* are magnified diagrams showing pre-secondary transfer neutralizing electrodes and belt surface regulating members.

Figure 2:
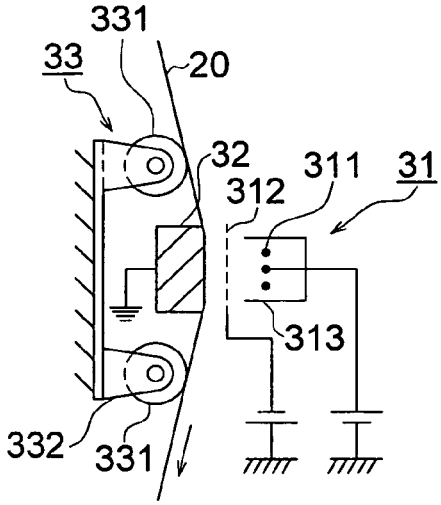
FIGS. 2*a* to 2*c* are magnified diagrams showing a pre-secondary-transfer neutralizing electrode and a belt surface regulating member.
Figure 2:
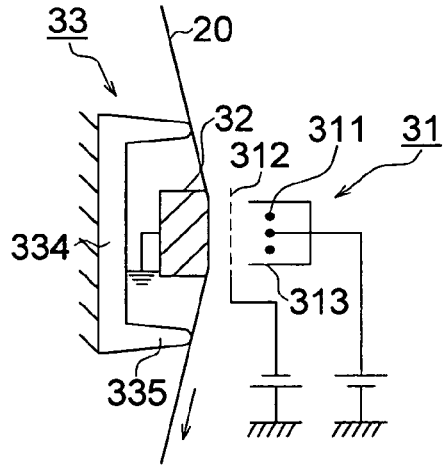
Figure 2:
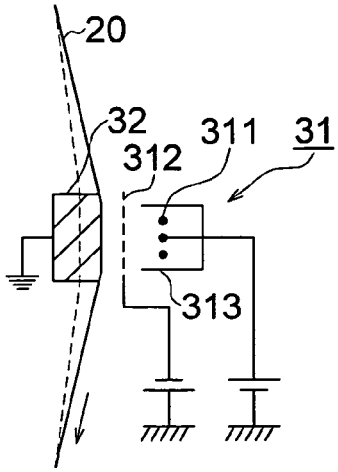
Figure 3:
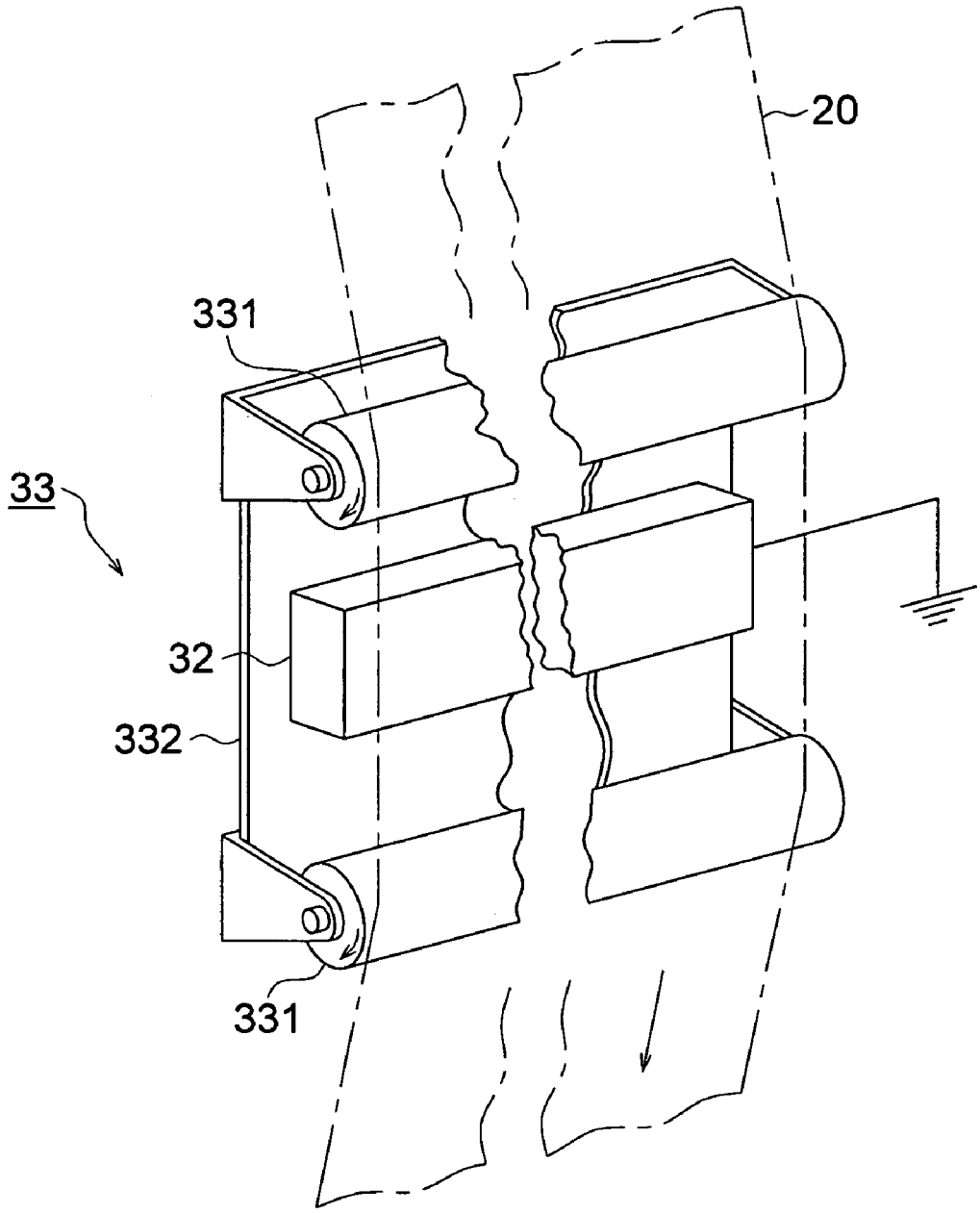
FIG. 3 is a perspective view of the belt surface regulating member in FIG. 2*a*.

FIG. 3 is a perspective view of the belt surface regulating member shown in FIG. 2*a*.

In FIGS. 2*a* to 2*c* and FIG. 3, a tungsten wire electrode 311 of the pre-secondary transfer neutralizing device 31 is applied with a voltage (electrical potential) on the opposite polarity to toner, and an added grid 312 is applied with a voltage of the same polarity as the toner. The grid 312 can be applied with an electrical potential E in a range from 0 to −300 V. Herein, a relationship is maintained where $E1$(electrical potential on an image with maximum toner-adherence)$>E>E2$(electrical potential on a part with no toner-adherence).

Further, the potential on a side plate 313 is the same as that on the grid 312.

The belt surface regulating member 33 includes, as shown in FIG. 2*a*, two belt tension-support rollers 331 that contact and support the intermediate transfer belt 20 (hereinafter, also referred to merely as a belt) from the back side of the belt and a support frame 332 that supports the rotation shafts of the belt tension-support rollers 331. The distance between the two belt tension-support rollers is preferably 30 to 100 mm. The support frame 332 is fixed at a predetermined position of a frame body, not shown, of the belt unit 3, and presses the back side of the intermediate transfer belt 20 to apply a predetermined tension (preferably 196 to 588 Pa) to the belt. The conductive elastic member is disposed between a plurality of the belt surface regulating members as shown in FIG. 2 and FIG. 3.

The counter electrode 32 is made from a conductive brush or sponge keeping tight contact with the back surface of the intermediate transfer belt 20. Further, the belt surface regulating member 33 has an effect of preventing the fluctuation of the belt which occurs during when the belt is running. If the belt surface regulating member 33 were not provided, the intermediate transfer belt 20 would fluctuate, as shown by a dashed line in FIG. 2*c*, and the running belt surface tends to be unstable, as described above. Further, the belt surface also changes due to the change of the elastic member with time. Such instability of the belt surface affects the downstream of the primary transfer nip section and the upstream of the secondary transfer nip section, which may make the transferred image quality unstable with splashing of toner to the periphery of a character and thin line part or roughness of an image caused by uneven discharge.

The invention has a feature of avoiding instability of image quality of a transfer image by providing a belt surface regulating member on the downstream side of the primary transfer nip section and on the upstream side of the secondary transfer nip section.

In the following, a confirmation test and comparison test of improvement of transfer image quality were performed with structures shown in FIGS. 4*a* and 4*b* to confirm the effects of a belt surface regulating member. Herein, in the present test, a conductive brush was employed as a counter electrode, and a pre-secondary transfer neutralizing device and the counter electrode were disposed at the place from where the image forming device 1 for K (black) in FIG. 1 was removed.

Figure 4:
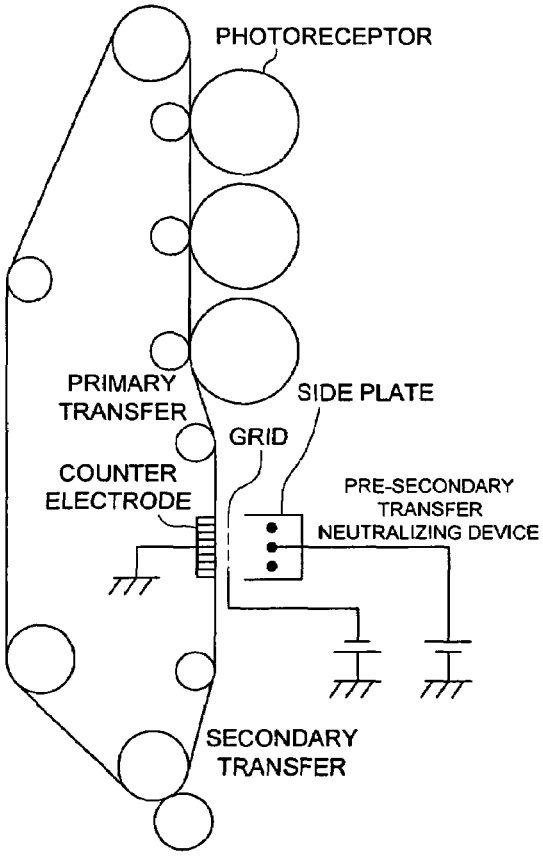
FIGS. 4*a* and 4*b* are diagrams showing image forming sections of testing machines for confirmation of the effects of the belt surface regulating member.
Figure 4:
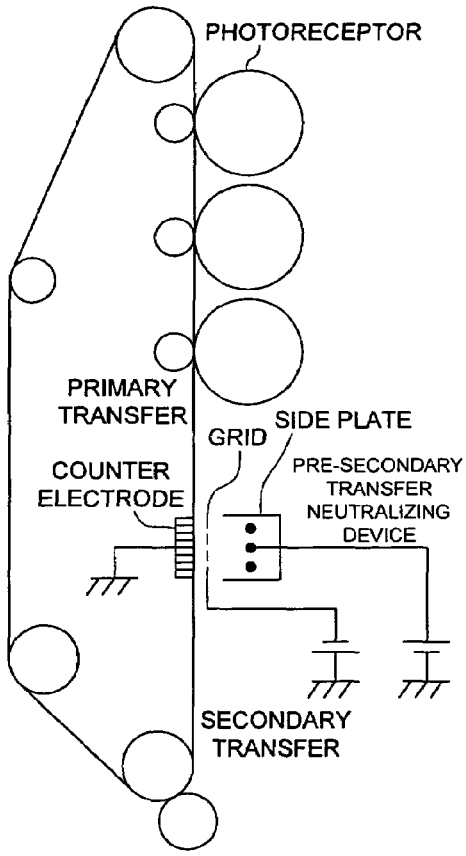

FIGS. 4*a* and 4*b* show the structures of image forming sections of testing apparatuses for confirmation of the effects of a belt surface regulating member.

Confirmation Test (Refer to FIG. 4*a*)

<Testing Conditions>

Testing machine: Tandem type color image forming apparatus (refer to FIG. 1)

Intermediate transfer belt:

Made of PI (polyimide), Volume resistivity $10^9\Omega$,

Surface resistivity $10^{11}\Omega$, Belt tension 39.2 N

Pre-secondary transfer neutralizer:

Photoreceptor and developing device of image forming device (K) on the fourth row are removed and the same type as scoroton charging electrode is provided at the position (refer to FIG. 4*a*).

Applicable voltage to electrode wire is 0 to 5 kV.

Grid electrode is applied with 0 to −300 V.

Potential on the side plate is the same as the grid electrode.

Neutralizing device width 30 mm

Neutralizing device length 320 mm

Distance between grid electrode and intermediate transfer belt is 1 mm.

Counter electrode: conductive acryl brush (original yarn resistance $10^2\Omega$, yarn diameter 3 d,
Density 31 kF/cm$^2$, Yarn length 4 mm)
Slight contact with belt back surface 294 Pa/cm$^2$,
Brush width 30 mm, Brush length 320 mm,
Earthed Belt surface regulating member:
Two belt tension-support roller distance 70 mm,
Roller material is stainless steel.
Roller diameter 12 mm <Image Quality Confirmation Test>

Durable test of image output was performed by image evaluation of character images and halftone images at the initial time and at a time after 100,000 copies.

<Evaluation Results>

Initial: Character image and halftone image were both favorable.

After 100,000 copies

Distortion of the conductive brush of the counter electrode occurred and the belt surface changed from the initial state. However, affects on the belt surface at the primary transfer section and secondary section were prevented by the two belt tension-support rollers. The primary transfer and secondary transfer showed no problem and both the character image and halftone image had favorable image quality.

Comparison Test (refer to FIG. 4*b*)

<Testing Conditions>

<Image Quality Confirmation Test>

Durable test of image output was performed in accordance with the testing conditions of the confirmation test except the case of no belt surface regulating member, and evaluation of image quality of a character image and halftone image was performed at the initial time and the time after 100,000 copies.

<Evaluation Results>

Initial: Character image and halftone image were both favorable.

After 100,000 copies:

Distortion of the conductive brush of the counter electrode occurred and the belt surface changed from the initial state. This changed the belt surface at the exit of primary transfer portion and the entrance of the secondary transfer portion from the initial state. Thus, roughness of the halftone image was caused by separating discharge at the exit of the primary transfer portion, and character distortion occurred at the entrance of the secondary transfer portion.

Thus, it proved that the structure shown in FIG. 4*b* causes the belt surface to fluctuate, which affects transfer processing at the primary and secondary positions.

From the result of the aforementioned confirmation and comparison tests, it proved that by providing a belt surface regulating member having a belt tension-support roller, the transfer portion is not affected by the fluctuation of the belt surface which occurs when the elastic member presses the back surface of the belt. Accordingly, it was made possible to prevent splashing of toner to the periphery of a character and thin line portion which could be caused by fluctuation of the belt surface before and after the transfer nip, and prevent roughness of image which could be caused by irregular discharge.

In the present confirmation test, a conductive brush was employed for the counter electrode, however, the same effect can be attained also by using an elastic member such as a conductive sponge.

Further, although two belt tension-support rollers were used for the belt surface regulating member, the same effect can be attained also by using a resin block 334 formed with ribs 335, as shown in FIG. 2*b*, for the belt surface regulating member.

What is claimed is:

1. An image forming apparatus for a color print having an intermediate transfer belt and a plurality of image forming devices disposed sequentially along a running direction of the intermediate transfer belt, wherein each image forming device has a photoreceptor and a developing device, and toner images formed on photoreceptors by the plurality of developing devices are primarily transferred in sequence onto the intermediate transfer belt at respective primary transfer positions to form a superimposed toner image and further the superimposed toner image is secondarily transferred in a batch onto a transfer member at a secondary transfer position, the apparatus comprising:

a charging or neutralizing device disposed at a part which is on a downstream side of the primary transfer position being on a most downstream side along the running direction of the intermediate transfer belt and on an upstream side of the secondary transfer position;

a conductive elastic member, as a counter electrode for the charging or neutralizing device, disposed on a back surface side of the intermediate transfer belt opposite to a surface on which the superimposed toner image is formed; and a belt surface regulating member disposed in a vicinity of the conductive elastic member to regulate a position of the surface of the intermediate transfer belt, wherein the belt surface regulating member has a rib shape.

2. An image forming apparatus for a color print having an intermediate transfer belt and a plurality of image forming devices disposed sequentially along a running direction of the intermediate transfer belt, wherein each image forming device has a photoreceptor and a developing device, and toner images formed on photoreceptors by the plurality of developing devices are primarily transferred in sequence onto the intermediate transfer belt at respective primary transfer positions to form a superimposed toner image and further the superimposed toner image is secondarily transferred in a batch onto a transfer member at a secondary transfer position, the apparatus comprising:

a charging or neutralizing device disposed at a part which is on a downstream side of the primary transfer position being on a most downstream side along the running direction of the intermediate transfer belt and on an upstream side of the secondary transfer position;

a conductive elastic member, as a counter electrode for the charging or neutralizing device, disposed on a back surface side of the intermediate transfer belt opposite to a surface on which the superimposed toner image is formed, wherein the conductive elastic member is disposed so as to contact with the back surface side of the intermediate transfer belt; and a belt surface regulating member disposed downstream of the primary transfer nip section or upstream of the secondary transfer nip section in a vicinity of the conductive elastic member to regulate a position of the surface of the intermediate transfer belt while the transfer belt being contacted with the conductive elastic member;

wherein the charging or neutralizing device comprises a scorotron electrode provided with a grid.

3. The image forming apparatus of claim 2, wherein the scorotron electrode is applied with a direct current voltage of opposite polarity to toner.

4. The image forming apparatus of claim 3, wherein the grid of the scorotron electrode is applied with a direct current voltage of the same polarity as the toner.

5. The image forming apparatus of claim 4, wherein an electrical potential E applied on the grid maintains a relationship:

E1(an electrical potential on an image with a maximum toner-adherence)>E>E2(an electrical potential on a part with no toner-adherence).

* * * * *